United States Patent [19]

Tsuneki

[11] Patent Number: 4,727,622

[45] Date of Patent: Mar. 1, 1988

[54] HINGE

[75] Inventor: Ken Tsuneki, Tokyo, Japan

[73] Assignee: Sugatsune Industrial Co., Ltd., Tokyo, Japan

[21] Appl. No.: 766,193

[22] Filed: Aug. 16, 1985

[30] Foreign Application Priority Data

Dec. 10, 1984 [JP] Japan ..... 59-260385

[51] Int. Cl.[4] ..... E05D 15/00; E05D 3/06

[52] U.S. Cl. ..... 16/368; 16/366; 16/370

[58] Field of Search ..... 16/354, 366, 368, 369, 16/370

[56] References Cited

U.S. PATENT DOCUMENTS 4,411,046 10/1983 Nawrath ..... 16/354

FOREIGN PATENT DOCUMENTS 800101 9/1950 Fed. Rep. of Germany ..... 16/354
58369 10/1967 Fed. Rep. of Germany ..... 16/368
2129252 12/1972 Fed. Rep. of Germany ..... 16/366
2526433 12/1976 Fed. Rep. of Germany ..... 16/368
1577156 8/1969 France ..... 16/368
2006585 12/1969 France ..... 16/370
2085517 4/1982 United Kingdom ..... 16/366

*Primary Examiner*—Nicholas P. Godici
*Assistant Examiner*—Carmine Cuda
*Attorney, Agent, or Firm*—Schwartz, Jeffery, Schwaab, Mack, Blumenthal & Evans

[57] ABSTRACT

The hinge is particularly adapted to permit a relatively thick door to be swung open without interference from the surrounding door mounting frame. A pair of arms pivotally connect the door to the frame, with the inner end of one of the arms being mounted on pin means having an axis about which the door rotates. Through the provision of various embodiments of connecting means and guide means, the pin means connecting the inner arm to the body travels in an arcuate, outward path when the door is opened, thereby moving the plane of the entire door outwardly to permit the room necessary to accommodate essentially full opening of the door. The pin means, during its arcuate movement, is guided by various forms of guide means to precisely define the arcuate path of travel.

6 Claims, 14 Drawing Figures

HINGE

BACKGROUND OF THE INVENTION

This invention relates to a hinge used to mount a door or the like.

When the thickness of a door is large and the door is mounted with a hinge or hinges, the door collides with a side plate of a cabinet or the like before the door is sufficiently opened, thereby resulting in the impossibility of opening the door in a wide angle if the door does not have hinge structure rotatable to considerably displace the door toward the outside.

Various discussions have been heretofore conducted to increase the displacing distance of the door described above, and various types of hinges have already been proposed. However, most of the proposed hinges employ a number of members, thereby resulting in the employment of considerable number of pectinated portions. Thus, the proposed hinges have a complicated construction, a large size are expensive, and also have the danger of interposing the ends of fingers between the various members when opening and closing the door.

However, the so-called two-blade hinge shown in FIGS. 13 and 14 is heretofore known as a hinge which does not have the defects described above and can open a wide angle of considerable degree of the existing hinges.

This hinge is constructed by pivotally securing the ends of arms e and f to a body b secured to a door mounting frame a and a socket d buried fixedly in a door c. The construction of this hinge is simple and has a relatively large displacing distance, which is still smaller than that of prior hinges. Therefore, the edge c' of the door c collides with the end of a wood side plate a' of the frame a and with an adjacent door g at the door opening time as shown in FIG. 14, and the opening angle the door is thus limited.

SUMMARY OF THE INVENTION

Accordingly, an object of this invention is to provide an improved hinge which has a small size, a simple and inexpensive construction, together with a large thickness for mounting a hinged door. The hinge eliminates the aforementioned drawbacks and disadvantages of the conventional hinge by sufficiently utilizing the advantages of the simple construction for pivotally connecting a body thereof to a socket with first and second arms to provide a large opening angle of the door. To this end, simple connecting means is provided at the end of the second arm f (see FIGS. 13 and 14) at the body side to shift the position of the door at the door closing time toward the outside at the door opening time without pivotally securing the second arm f to a predetermined position of a body b as the conventional hinge. Guiding means for shifting the position of the door at the door closing time is merely added, thereby increasing the displacing distance of the door by the shift of the door and opening the door at a wide angle by the minimum additional construction.

In order to achieve the above and other objects, there is provided a hinge which comprises a body, a socket, an outer arm for connecting one end thereof to the socket, an inner arm for pivotally connecting the other end thereof to the body, pivotal connecting means for connecting the other end of the arm to the body to be circularly movably in forward and backward directions, and guide means between the other end of the inner arm and the body for guiding the movement of the other end of the inner arm.

According to this invention, when the door provided with the hinge or hinges of the invention is opened from the closed state, the guide means guides the other end of the inner arm toward a displacing direction by the opening movement of the inner arm, with the result that the other end of the inner arm is shifted by the pivotal securing means in the displacing direction. Thus, the door is opened while the door is displaced toward the outside, and the door provided with the hinge or hinges of the invention avoids the disadvantages of the conventional hinge that the edge of the door consequently collides with the door mounting frame so that the door quickly reaches the opening limit.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

The present invention will now be described in more detail with reference to the accompanying drawings.

Figure 1:
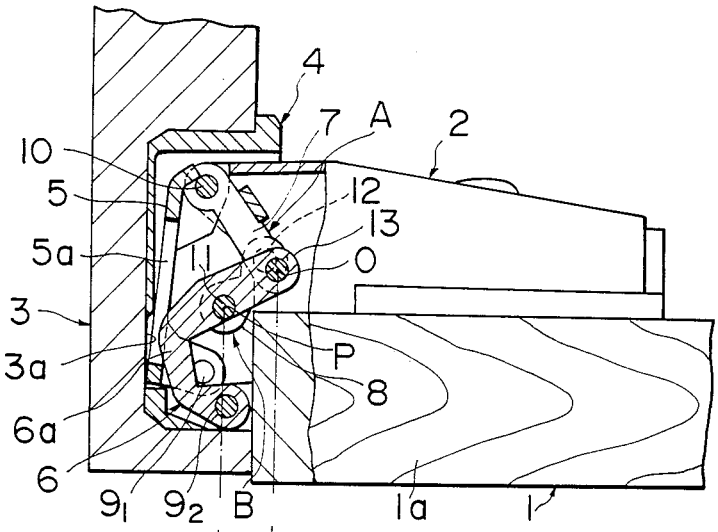
FIGS. 1 and 2 are fragmentary side views of a first embodiment of a hinge in a door closed and open state, respectively according to the present invention.
Figure 2:
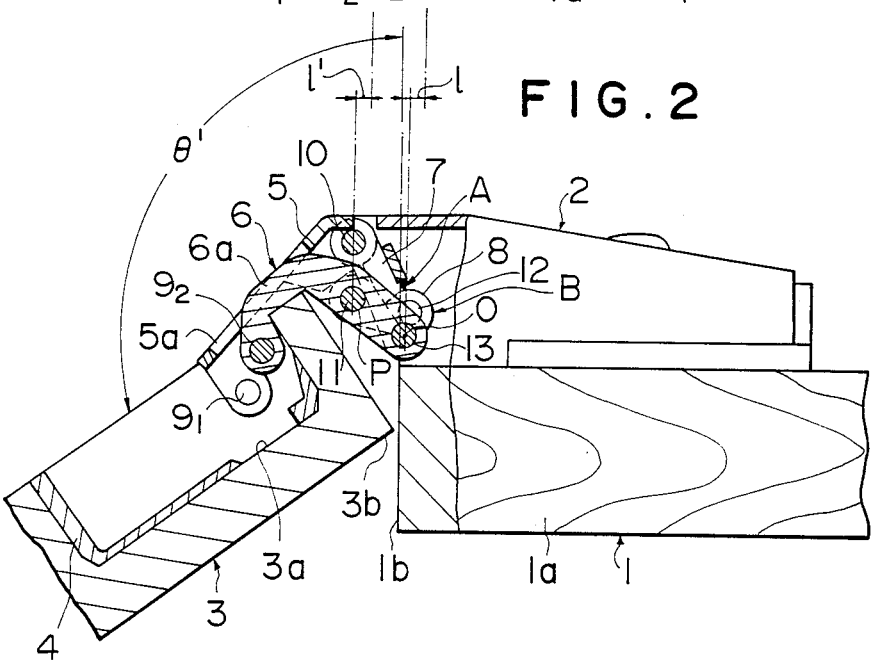

FIGS. 1 and 2 show a first embodiment of a hinge according to the present invention. The hinge of the first embodiment generally comprises a body 2 capable of being fixedly secured to a door mounting frame 1, a cup-shaped socket 4 engaged fixedly within a recess 3*a* formed on a door 3, an outer first arm 5 and an inner second arm 6 for connecting the body 2 and the socket 4. The first embodiment of the hinge further comprises a first link 7 and a second link 8.

The first and second arms 5 and 6 can be contained in the socket 4 in a door closed state as shown in FIG. 1, and the first arm 5 is formed substantially in U-shaped cross section so that the second arm 6 can be disposed inside the first arm 5. The second arm is formed of a mere flat plate.

The first and second arms 5 and 6 are constructed in the same manner as the conventional hinge so that the ends bent inside are pivotally secured by shaft pins $9_1$, $9_2$ at an interval for eliminating a mutual interference to each other with the front side thereof in the socket 4, and the other end of the first arm 5 is pivotally secured by a shaft pin 10 to the front upper end projected forwardly of the body 2.

The hinge of the first embodiment further comprises pivotal connecting means A and guide means B. The connecting means A is a mechanism for circularly moving the other end of the second arm 6 at the body side in forward and backward directions. In the first embodiment of the hinge of the invention, the connecting means A comprises the first link 7 pivotally secured to the body 2 via a shaft pin 10 of the body pivotally supporting point of the first arm 6, and a shaft pin 13 for pivotally securing the other ends of the first link 7 and the second arm 6.

As described above, the pivotal securing point O of the shaft pin 13 can be circularly shifted in forward and backward directions in a range of the shaft pin 10 as a center and the first link 7 as a radius.

The guide means B is a mechanism for guiding and shifting the pivotal securing point O forwardly at the door opening time. The guide means B of this embodiment comprises the second link 8 pivotally secured by the shaft pin 12 to the body 2, and a shaft pin 11 for pivotally securing the other end of the link 8 and the portion of the second arm 6, displaced to the other end thereof.

The first and second links 7 and 8 of the first embodiment shown in FIGS. 1 and 2 are formed to be considerably shorter than the first and second arms 5 and 6, and the second link 8 is shorter than the first link 7. The pivotal securing point P of the shaft pin 11 is circularly moved forwardly in a range of the shaft pin 12 as a center and the second link 8 as a radius by the movement of the second arm 6 upon opening or closing of the door 3, thereby shifting forwardly the point P of the shaft pin 13 as described above.

Figure 14:
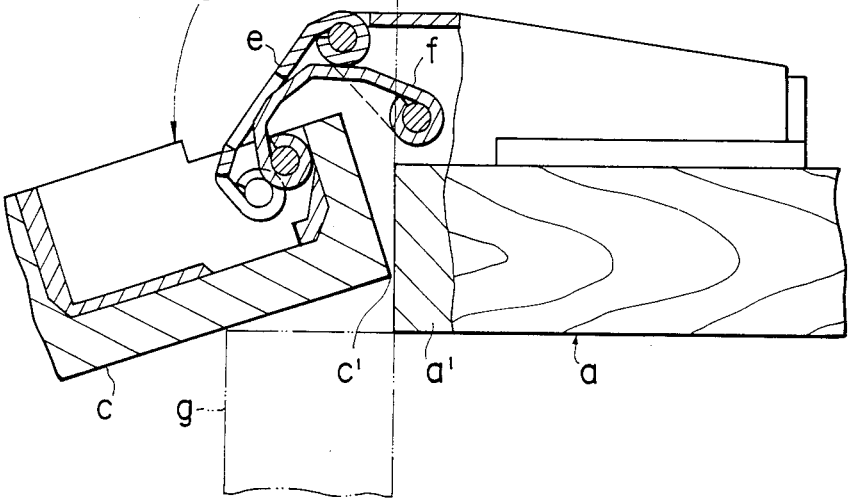
FIG. 14 PRIOR ART

More particularly, the pivotal securing points O and P are provided respectively to displace forwardly at the distances l, l', when the door is opened from the closed state of FIG. 1, thereby opening the door 3 to an opening angle $\theta'$ larger than $\theta$ as shown in FIG. 14.

Consequently, when the door 3 is opened or closed by the hinge of the first embodiment of the present invention described above, the first arm 5 is rotated at the shaft pin 10 of the pivotal securing point with the body 2 as a fulcrum point, while the second arm 6 is rotated at the second link 8 pivotally secured from the other end of the second arm 6 at the shaft pin 12 of the pivotal securing point with the body 2 as the fulcrum point. At this time, the first link 7 is rotated at the shaft pin 10 of the pivotal securing point with the body 2 as a fulcrum point. Accordingly, the pivotal securing point O of the second arm 6 pivotally secured to the shaft pin 10 and the pivotal securing point P of the second link 8 to the second arm 6 are displaced forwardly at the distances l, l', when the door is opened from the closed state, thereby eliminating the disadvantage that the edge 3*b* of the door 3 prematurely collides with the end 1*b* of the side plate 1*a* of the door mounting frame 1, or prematurely collides with the other door, not shown, mounted adjacent to the door.

In the first embodiment of the invention shown in FIGS. 1 and 2 and described above, a window opening 5*a* is formed in the portion of the first arm 5 opposite to the second arm 6 so that the bent portion 6*a* of the second arm 6 is disposed in the window opening 5*a* of the arm 5, thereby avoiding interference between the arms and providing an opening angle $\theta'$ of wide degree with a hinge of small size.

The door 3 is mounted in the same manner as the known hinge of this type in the lateral direction of the door 3 by clamping the body 1 on the inner surface of the side plate 1*a* of the door mounting frame 1 with screws, and the socket 4 is clamped with screws after forming a recess 3*a* on the inside of the base end of the door 3 and engaging them.

Figure 3:
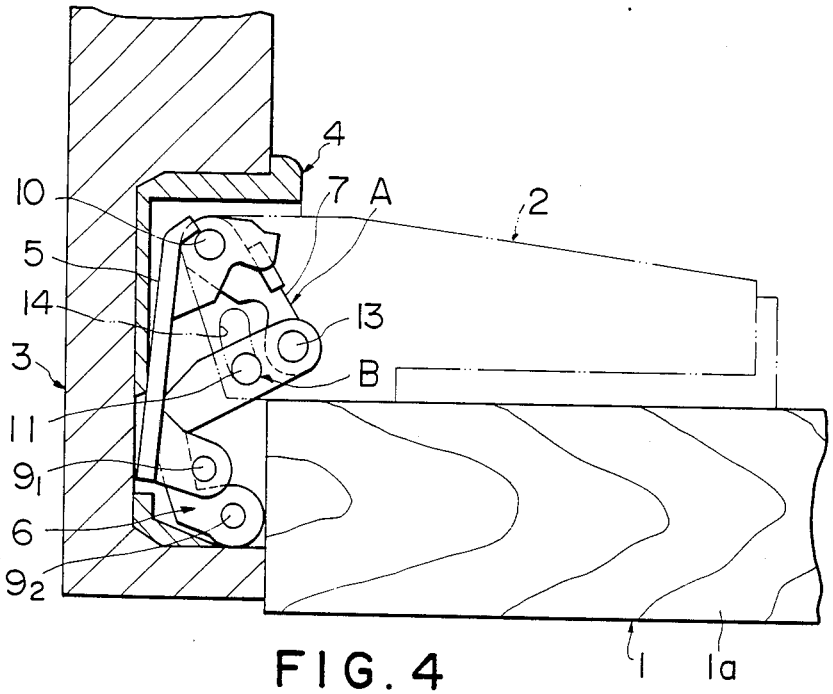
FIGS. 3 and 4 are fragmentary side views similar to FIGS. 1 and 2 but showing a second embodiment of a hinge according to the present invention.
Figure 4:
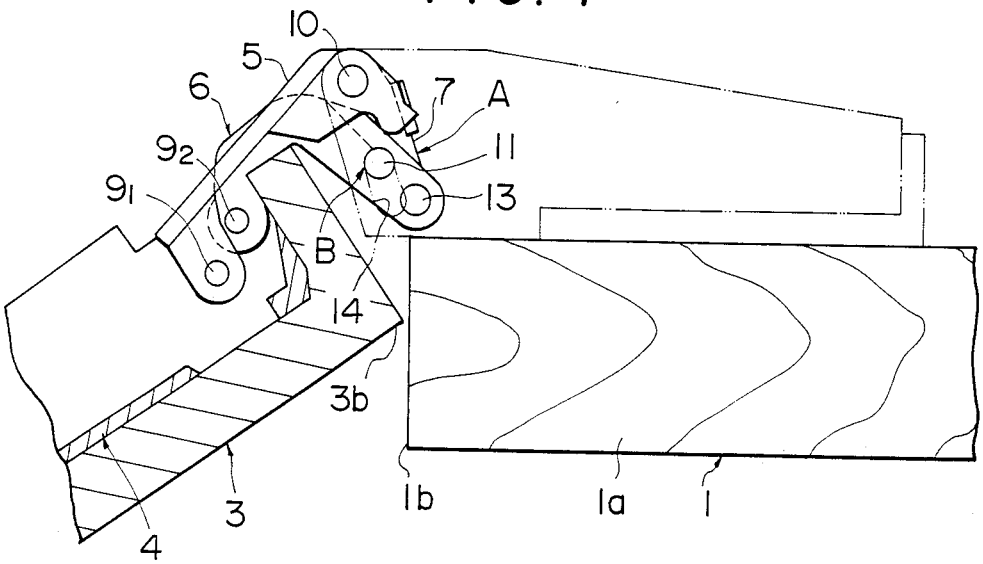

In a second embodiment of a hinge according to the present invention shown in FIGS. 3 and 4, the fundamental construction is substantially the same as that of the first embodiment of the invention, wherein the same reference numerals designate the same or equivalent members and components, except that guide means B comprises a guide opening 14 perforated circularly at the body 2, and a shaft pin 11 formed at the portion of the second arm 6, displaced toward the other end of the arm 6 to be engaged slidably with the guide opening 14.

As described above, the shaft pin 11 is restricted and guided by the perforated shape of the guide opening 14 to move in the same manner as that the second link 8 is rotated and shifted as a radius at the shaft pin 12 as a center.

Figure 5:
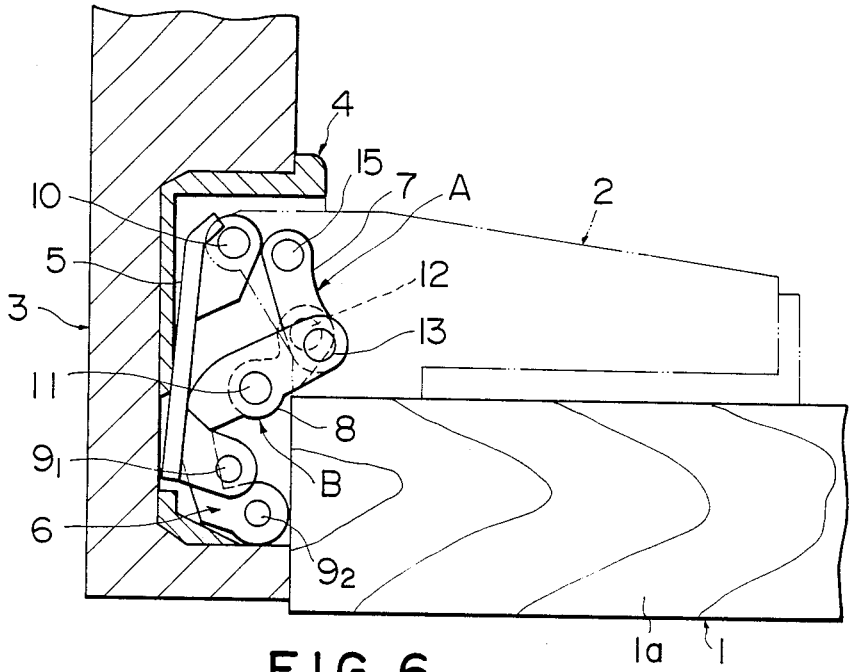
FIGS. 5 and 6 are fragmentary side views similar to FIGS. 1 and 2 but showing a third embodiment of a hinge according to the present invention.
Figure 6:
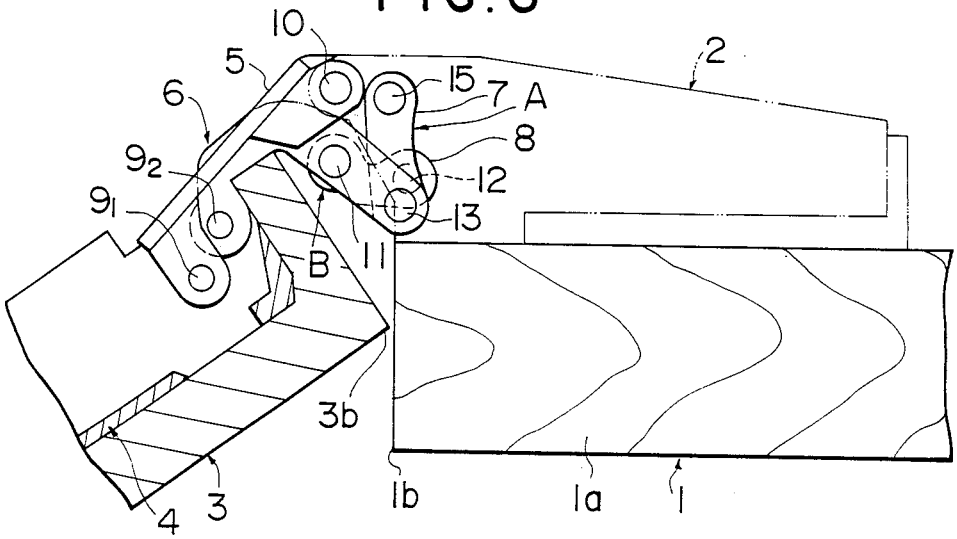

The fundamental construction of a third embodiment of a hinge according to the present invention shown further in FIGS. 5 and 6 is the same as that of the first embodiment, except that pivotal connecting means A comprises a first link 7 and a shaft pin 13. One end of the first link 7 is commonly used as a shaft pin 13 but not pivotally secured to a body 2, but the link 7 is pivotally secured to the body 2 by a pivotal securing shaft pin 15 provided entirely separately. Thus, the shift of the shaft pin 13 of the third embodiment is also provided in the same manner as the first and second embodiments as a different shaft construction.

Figure 7:
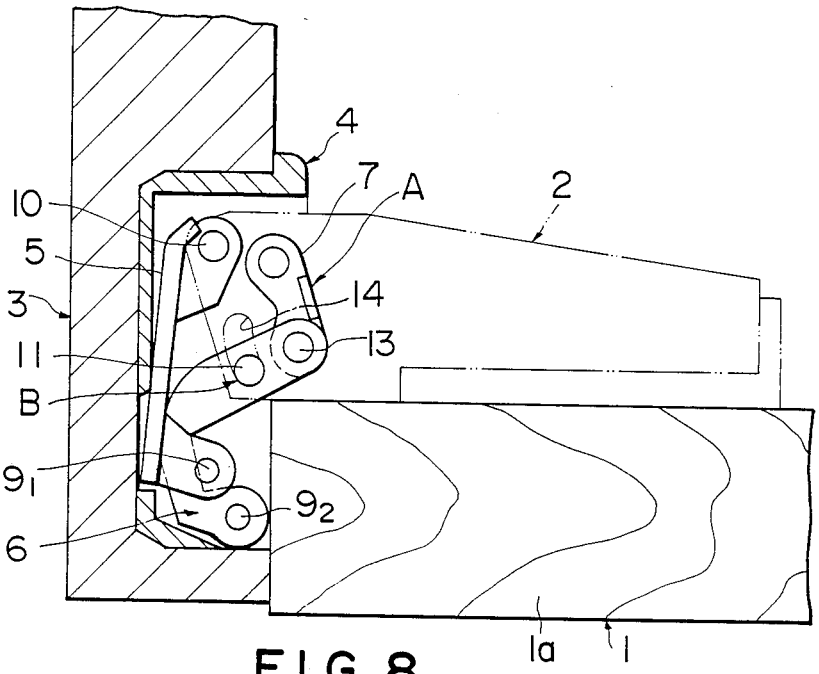
FIGS. 7 and 8 are fragmentary side views similar to FIGS. 1 and 2 but showing a fourth embodiment of a hinge according to the present invention.
Figure 8:
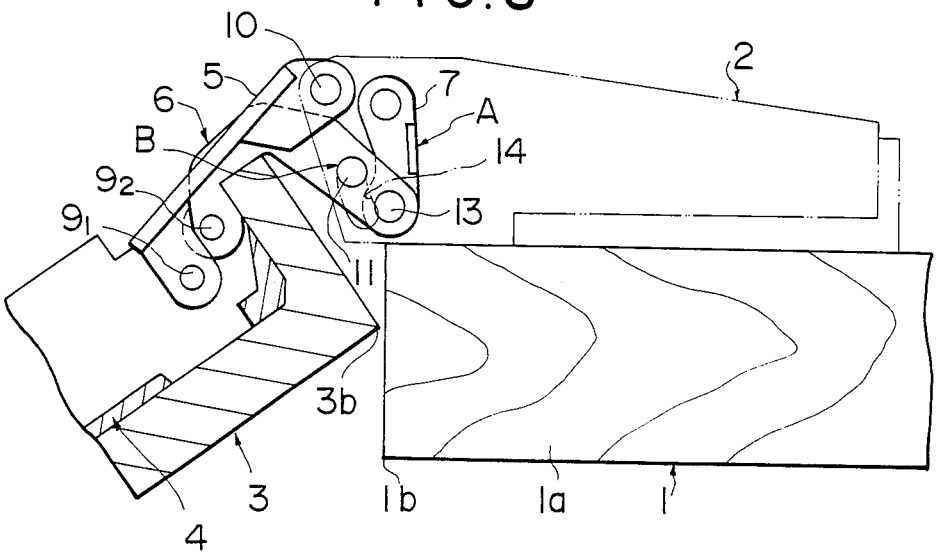

A fourth embodiment of a hinge according to the present invention shown in FIGS. 7 and 8 employ the different shaft construction shown and described with respect to the third embodiment (FIGS. 5 and 6) for pivotally connecting means A and in combination with a guide opening 14 exemplified in the second embodiment (FIGS. 3 and 4) as guide means B.

Figure 9:
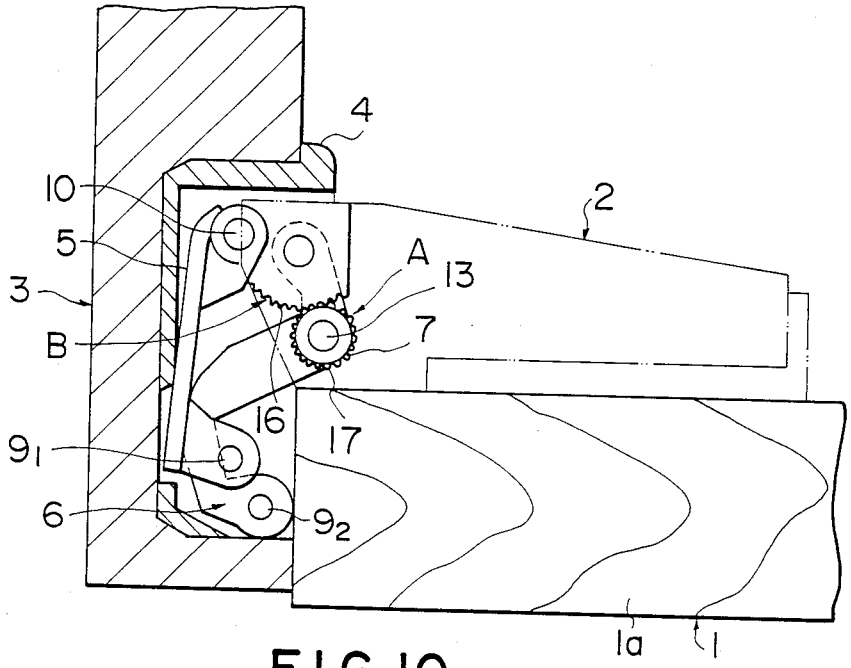
FIGS. 9 and 10 are fragmentary side views similar to FIGS. 1 and 2 but showing a fifth embodiment of a hinge of the invention.
Figure 10:
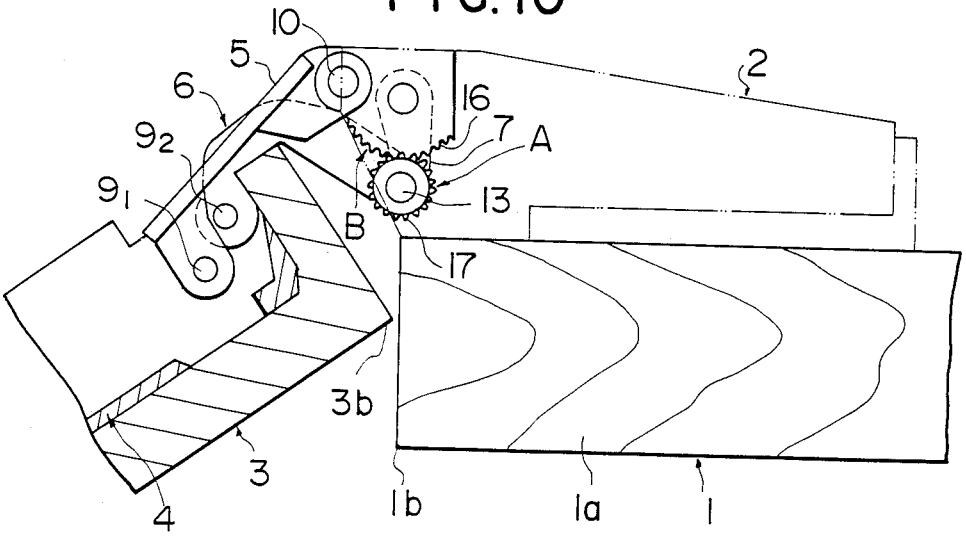

In a fifth embodiment of a hinge according to the present invention shown in FIGS. 9 and 10, pivotal connecting means A is constructed in the same manner as the third and fourth embodiments having the first link 7, but guide means B is different from those of the previous embodiments of the invention.

More specifically, a guide toothform 16 fixedly provided on a body 2 and projected circularly in a downward direction on the body 2, and guide means comprises a guide gear 17 fixedly secured to the second arm 6 coaxially with the shaft pin 13 of the pivotally securing point of the first link 7 and the second arm 6 in engagement with the guide toothform 16.

According to the fifth embodiment of the invention, the guide gear 17 is guided forwardly in engagement with the guide toothform 16 of the body 2 by opening the closed door, as shown in FIG. 10, and the shaft pin 13 is restricted by the first link 7 at this time so that the shaft pin 13 does not shift forwardly by the circular locus.

Figure 11:
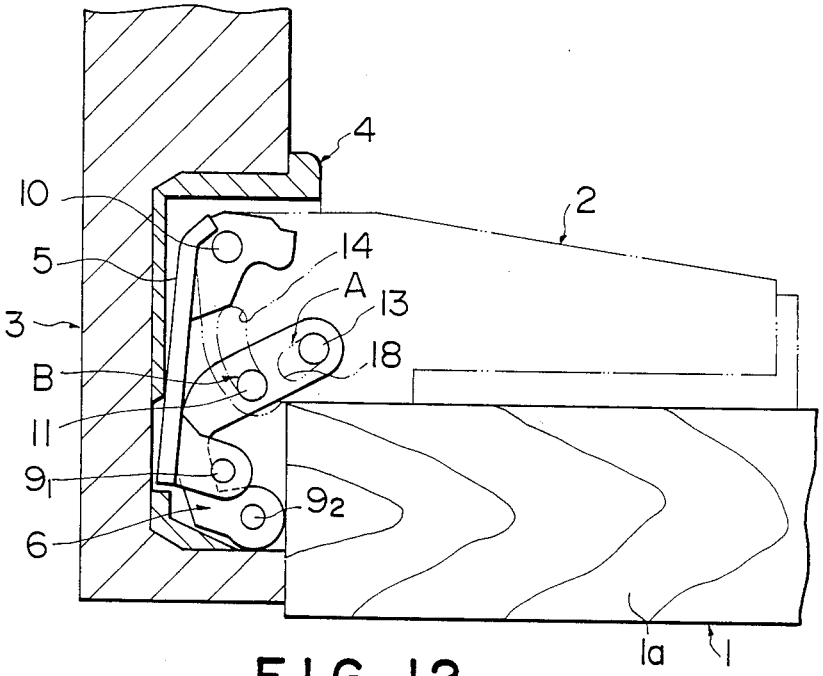
FIGS. 11 and 12 are fragmentary side views similar to FIGS. 1 and 2 but showing a sixth embodiment of the invention.
Figure 12:
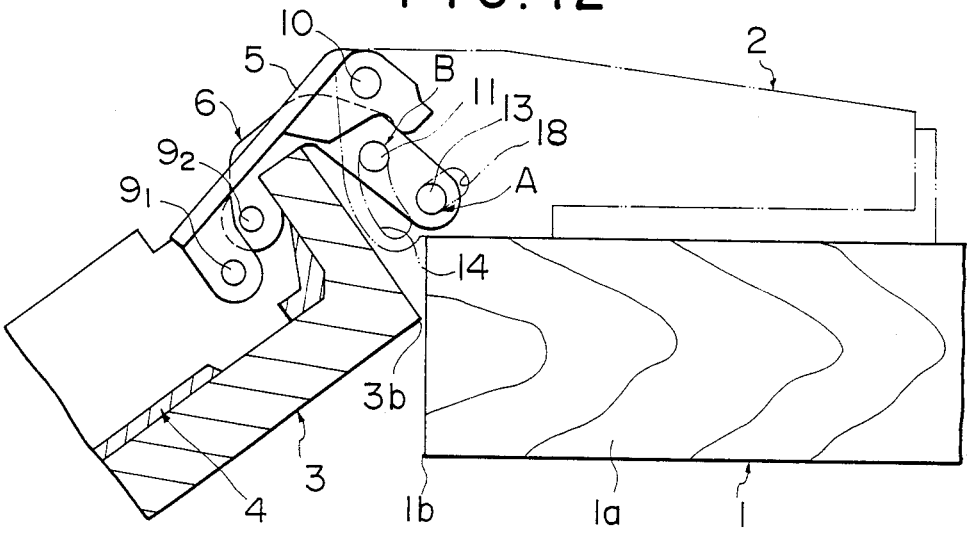
Figure 13:
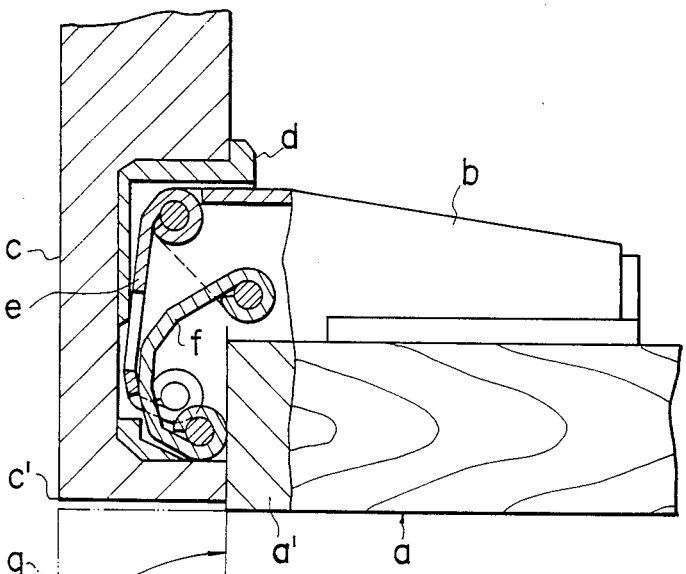
FIG. 13 PRIOR ART
FIGS. 13 and 14 are fragmentary side views of a conventional two-blade hinge in closed and opened states.

In a sixth embodiment of a hinge according to the invention shown in FIGS. 11 and 12, guide means B employs a guide opening 14 and a shaft pin 11 in the same manner as the second (FIGS. 3 and 4) and fourth (FIGS. 7 and 8) embodiments, and pivotal connecting means A employs substantially the same construction as the guide means B.

More particularly, the pivotal connecting means A comprises a pivotal connecting opening 18 perforated circularly at the body 2, and a shaft pin 13 slidably engaged with the opening 18, thereby restricting and guiding the shaft pin 13 through the opening 18 to be circularly forwardly shiftable in the same manner as the previous embodiments of the invention.

According to all of the several embodiments of present invention described above, the guide means B can shift forwardly the shaft pin 13 of the second arm 6 upon opening and closing of the door, with the result that the door can be opened while the socket 4 is displaced forwardly, thereby substantially increasing the opening angle of the door provided with the hinge of the invention.

In this case, the shaft pin 13 of the second arm 6 can be selectively shifted forwardly. Therefore, as apparent from the comparison of a shiftable locus circular arc of the shaft pin $9_1$ with the shaft pin 10 of the first arm 5 as a center with a shiftable locus circular arc of the shaft pin $9_2$ with the shaft pin 13 of the second arm 6 as a center, the shaft pin $9_1$ gradually rises while moving forwardly, while the shaft pin $9_2$ abruptly rises while moving forwardly. Consequently, the door can be sufficiently displaced forwardly and upwardly with the forward shifting construction of the shaft pin 13, with the result that the edge of the door hardly collides with the end of the side plate of the door mounting frame as shown in FIG. 2, and the early collision with the adjacent door described with respect to FIG. 14 can be effectively eliminated by the abovementioned shift of the door.

According to the invention as described above, the pivotal connecting means A and the guide means B do not fundamentally alter the simple construction of the so-called conventional two-blade hinge, but a mere addition of a small member or a perforation of the opening at the body is sufficient. Consequently, the hinge of the present invention can readily employ a small size, a large strength, and can eliminate an unintentional damage of fingers with remarkably inexpensive cost as compared with the conventional hinge of complicated construction, thereby meeting the demand of doors of large thickness.

What is claimed is:

1. A door hinge particularly adapted to permit a relatively wide opening movement of a relatively thick door, said door having a socket the depth of which is such that a substantial portion of the moving parts of the hinge is confined when the door is closed, the width of said socket being greater than the width of the moving components of the hinge, comprising:

(a) a body adapted to be fixedly secured to a frame for said door, said door in the area adjacent said socket engaging the forward surface of said frame when said door is closed;

(b) first and second arms for pivotally connecting the socket of said door to said body, said second arm having an outer end mounted in said socket and an inner end mounted on movable pin means having an axis about which said door rotates, the axis of said pin means being only slightly rearwardly of said forward surface of said frame when said door is closed and being essentially in the plane of said forward surface when said door is opened;

(c) connecting means comprising a first link connected at one end to said body and at its other end to said pin means, and (d) guide means comprising a second link pivotally connected at one end thereof to said body and at its other end to a shaft pin mounted on said second arm forwardly of said pin means, whereby when said door is opened, said pin means travels through an arcuate forward path so as to space said door from the frame to permit a more wide-open movement of the door.

2. The door hinge of claim 1 wherein said one end of said first link is connected by a pin to said first arm, and wherein said first arm is formed with a window into which a portion of said second arm extends when the door is fully open.

3. A door hinge particularly adapted to permit a relatively wide opening movement of a relatively thick door, said door having a socket in which a substantial portion of the moving parts of the hinge is confined when the door is closed, the width of said socket being greater than the width of the moving components of the hinge, comprising:

(a) a body adapted to be fixedly secured to a frame for said door;

(b) first and second arms for pivotally connecting the socket of said door to said body, said first arm having a first end fixedly connected to said body and a second end fixedly connected to said socket, said second arm having an outer end mounted in said socket and an inner end mounted on movable pin means having an axis about which said door rotates;

(c) connecting means comprising a link connected at one end to said body and at its other end to said first pin means;

(d) an arcuate guide slot formed in said body forwardly of said link, and (e) a second pin means on said second arm and movable in said arcuate guide slot, whereby when said door is opened, said second pin means travels in said arcuate guide slot and said first pin means travels forwardly so as to space said door from the frame to permit a more wide-open movement of the door.

4. The hinge of claim 3, wherein said first arm is formed with a window into which a portion of said second arm extends when the door is fully open.

5. A door hinge particularly adapted to permit a relatively wide opening movement of a relatively thick door, said door having a socket in which a substantial portion of the moving parts of the hinge is confined when the door is closed, the width of said socket being greater than the width of the moving components of the hinge, comprising:

(a) a body adapted to be fixedly secured to a frame for said door;

(b) first and second arms for pivotally connecting the socket of said door to said body, said second arm having an outer end mounted in said socket and an inner end mounted on first pin means having an axis about which said door rotates;

(c) means for connecting said first pin means and said body, said connecting means comprising a first guide slot in which said first pin means engages to permit said first pin means to travel through a path forwardly when the door is opened, thereby spacing said door from the frame to permit a more wide-open movement, and backwardly when the door is closed, and (d) guide means for guiding the travel of said first pin means, said guide means comprising a second arcuate slot formed in said body forwardly of said first slot, and second pin means on said second arm forwardly of said first pin means and engagable in said second slot, whereby when door is opened, said second pin means moves arcuately in said second slot thereby permitting said first pin means to move forwardly in said first slot to space the door from the frame.

6. The hinge of claim 5 wherein said first arm is formed with a window into which a portion of said second arm extends when the door is fully open.

* * * * *